United States Patent [19]

Overy

[11] Patent Number: 4,770,316

[45] **Date of Patent: * Sep. 13, 1988**

[54] POWER DEVICE HOUSING WITH LUBRICANT ANTI-WICKING FACILITY

[75] Inventor: Colin Overy, Brockville, Canada

[73] Assignee: Black & Decker Inc., Neward, Del.

[ * ] Notice: The portion of the term of this patent subsequent to Feb. 10, 2004 has been disclaimed.

[21] Appl. No.: 912,103

[22] Filed: Sep. 29, 1986

Related U.S. Application Data

[63] Continuation of Ser. No. 705,326, Feb. 25, 1985, Pat. No. 4,641,762.

[51] Int. Cl.[4] ..... B65D 25/54

[52] U.S. Cl. ..... 220/81 R; 220/67; 220/4 R

[58] Field of Search ..... 220/81 R, 75, 76, 81 A, 220/67

[56] References Cited

U.S. PATENT DOCUMENTS

| | | | |
|---|---|---|---|
| 2,910,209 | 10/1959 | Nelson . | |
| 3,003,658 | 10/1961 | Lindsey | 220/81 R |
| 3,007,603 | 11/1961 | Krehl | 220/81 R |
| 3,123,109 | 3/1964 | Bork . | |
| 3,693,985 | 9/1972 | Dillner . | |
| 3,885,701 | 5/1975 | Becklin | 220/81 R |
| 4,219,125 | 8/1980 | Wiltshire et al. | 220/81 R |
| 4,251,082 | 2/1981 | Little . | |
| 4,546,874 | 10/1985 | Kirchhan | 220/81 R |

FOREIGN PATENT DOCUMENTS

| | | |
|---|---|---|
| 1097910 | 1/1968 | United Kingdom . |

*Primary Examiner*—Joseph M. Moy

*Attorney, Agent, or Firm*—J. Bruce Hoofnagle; Harold Weinstein; Edward D. Murphy

[57] ABSTRACT

In a housing (22) for a right-angle grinder (20), a pair of clamshell sections (24) and (26) are joined along a mid-plane (28). The interior of the housing (22) is formed with a motor case (34) and a gear case (36). Clamshell section (26) is formed with a rib (76) in a peripheral edge (72) thereof and is nested in a groove (58) formed in a peripheral edge (56) of clamshell section (24) to form an interlock for the housing (22). Slots (78) and (80) are formed transversely through the rib (76) along two spaced paths of the interlock to preclude a flowable lubricating substance from creeping from gear case (36), along the two spaced paths of the interlock to the motor case (34).

7 Claims, 3 Drawing Sheets

POWER DEVICE HOUSING WITH LUBRICANT ANTI-WICKING FACILITY

This application is a continuation of application Ser. No. 705,326, filed Feb. 25, 1985 now U.S. Pat. No. 4,641,762.

BACKGROUND OF THE INVENTION

This invention relates generally to a power device with a lubricant anti-wicking facility and particularly to a power tool with facility for precluding wicking of lubricants and other forms of flowable substances from one compartment of a housing of the tool undesirably into and about the exterior of another compartment of the housing.

In some types of hand-held power tools such as, for example, drills, grinders, jig saws and the like, a plastic housing provides support for a motor in one compartment, referred to as a motor case, and gears in an adjacent compartment, referred to as a gear case. Typically, the housing is composed of two mating shell-like elements referred to as clamshell sections. Each clamshell section has an open side and is formed with a maze of inner walls which extend to the open side of the clamshell section. The walls separate the inner area of the clamshell section into the compartments which form the motor and gear cases. Further, each clamshell section and related walls are formed with peripheral edges or rims which are located in a common plane at the open side of the clamshell section.

During assembly of the various components of the power tool, the motor, gears and other components of the tool are assembled in respective compartments of one of the clamshell sections and interconnected for ultimate operation. In addition, the gears and bearings can be lubricated easily while exposed in assembly with the one clamshell section.

The mating clamshell section is then assembled with the clamshell section which contains the motor and the gears in such a manner that the peripheral edges of the clamshell sections are placed in facing engagement to form the housing of the tool. In addition, the peripheral edges of the walls of the mating clamshell sections are also placed into facing engagement to form enclosed compartments within the housing. The enclosed compartments then form the motor and gear cases. Fasteners, such as screw fasteners, are used to retain the clamshell sections in the assembled relation.

To preclude lateral movement of one of the assembled clamshell sections relative to the other, the peripheral edge of one of the clamshell sections is formed with an outwardly projecting rib while the peripheral edges of the other clamshell section is formed with an accommodating groove. When the clamshell sections are assembled, the rib is inserted into and nested in the groove to provide an interlock between the clamshell sections and thereby preclude relative lateral movement of the clamshell sections before and after the fasteners have been applied.

During use of the tool, the lubricant in the gear case is worked by the moving gears and is deposited on the inner walls of the gear casing. Subsequently, the lubricant deposits undesirably into the portion of the interlock which is contiguous with the gear case and begins to creep, by wicking or capillary action, to other portions of the interlock which are contiguous with the adjacent motor casing. Eventually, the creeping lubricant, which collects dirt and dust particles from inside and outside the housing, flows from the interlock onto the outside of the housing in the vicinity of the motor case and creates handling difficulties for an operator who normally holds this area when the tool is being used. In addition the creeping lubricant is drawn into the motor case by the flow of cooling air about the motor and contaminates the motor which affects the safe and efficient operation of the motor and causes a deterioration of motor parts.

The lubricant wicking problem is common where gears requiring lubrication are placed, by necessity, close to the motor and where the common housing for the gears and motor is formed with structure which accommodates creepage of the lubricant. Traditionally, attempts to solve this problem have included a variety of techniques such as the use of interference fits and rubber seals as well as the application of various sealing compounds.

While the foregoing techniques for reducing leakage of lubricants from a gear case are effective, they all require considerable additional effort and special facility for effecting the leakage reduction. For example, each technique noted above requires the assembly or application of additional elements to the power operated device, such as the power tool. These assembly or application techniques require additional costly and time-consuming efforts during assembly of the tool components. Further, in many instances, the tool must be designed, or redesigned, to accommodate the elements necessary to accomplish the reduction of leakage loss of the lubricant.

Consequently, notwithstanding the traditional techniques noted above, there still exists a need to find a relatively inexpensive and highly effective technique for eliminating the undesirable creepage of lubricant from a lubricant-containing compartment of a power device housing, along an interlock of the housing and hence to the exterior and interior areas of another compartment of the housing.

SUMMARY OF THE INVENTION

In accordance with the broad teachings of the present invention, a housing for a power device is formed by assembling a first means and a second means to provide at least one compartment within the housing and with means for interlocking the first and second means in the assembled relationship. Means are provided for precluding the movement of any flowable substance from the compartment, along the interlocking means to another area of the housing spaced from the compartment.

In accordance with specific teachings of the present invention, a first shell-like section is formed with a rib along its peripheral edge and with internal walls to form at least two compartments. A second shell-like section is formed with a groove along its peripheral edge and also with walls to form at least two compartments. The first and second sections are assembled with the peripheral edges being in interfacing relation and with the rib nested in the groove to form an interlock for the housing. In the assembled housing, the two compartments of the first section mate with the two compartments of the second section to form a gear case and an adjacent motor case. At least two gaps are formed transversely in the rib at locations between the gear case and the motor case to preclude flow of a lubricating substance from the gear case, along the interlock and hence to interior and exterior areas of the motor case.

DETAILED DESCRIPTION

Figure 1:
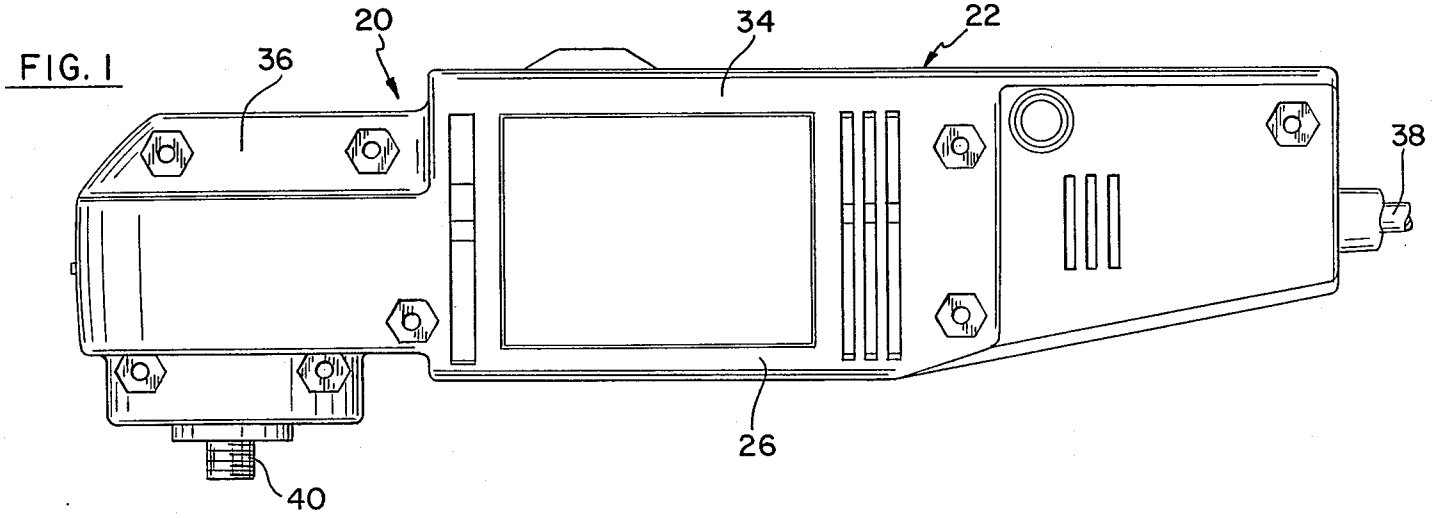
FIG. 1 is a side elevation view showing one type of power tool embodying certain principles of the invention.
Figure 2:
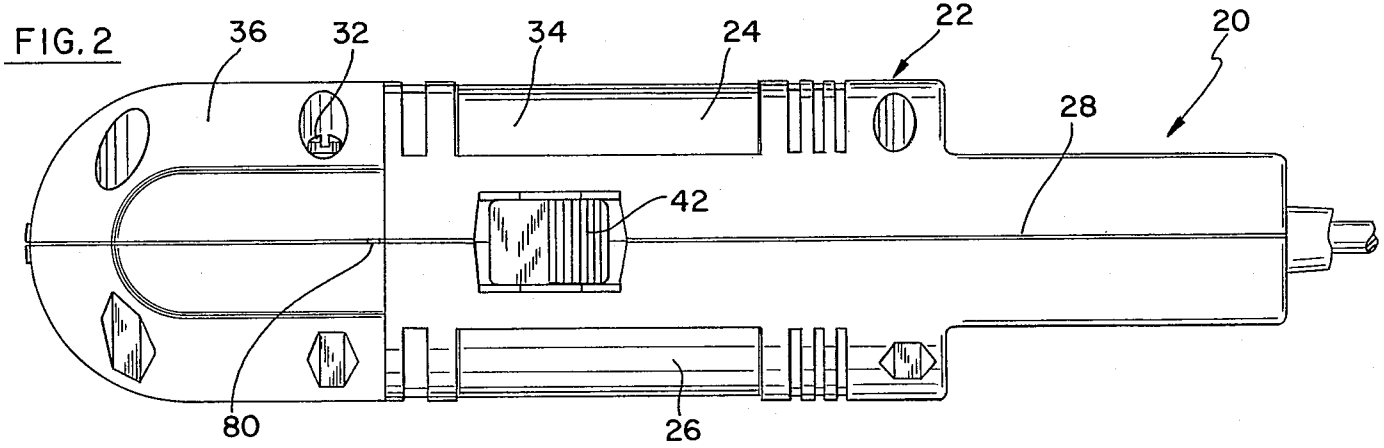
FIG. 2 is a plan view showing the power tool of FIG. 1.

Referring to FIGS. 1 and 2, there is illustrated a power tool such as a right-angle portable grinder 20 which embodies the teachings of the present invention. However, as will be appreciated by those skilled in the art, the teachings of the present invention are not restricted to the grinder 20 but are equally applicable to a wide variety of power devices as will become apparent from the following description.

As illustrated in FIG. 2, the grinder 20 includes a clamshell housing 22 which is formed by first and second housing means which, due to a shell-like configuration, are referred to as clamshell sections 24 and 26. The clamshell sections 24 and 26 are composed of a suitable plastic material molded into the desired configuration and are joined together along a shadow-line or midplane 28 in a complementary mating fashion. Fasteners, such as self-tapping screws 30 (FIG. 2), are used to assist in holding the clamshell sections 24 and 26 in the assembled relation. When assembled, the housing 22 forms a motor case 34 and a gear case 36 which house a motor (not shown) and gearing (not shown), respectively. A power cord 38 enters the housing 22 at one end thereof while a driving spindle 40 (FIG. 1) extends from the other end of the housing to receive grinding attachments (not shown). The power cord 38 is connected to the motor through a switch 42 to permit control of the operation of the grinder 20 externally thereof. The motor is mechanically coupled to the gearing which is mechanically connected to the driving spindle 40 to facilitate the application of driving motion to the spindle and any attachment secured thereto.

Figure 3:
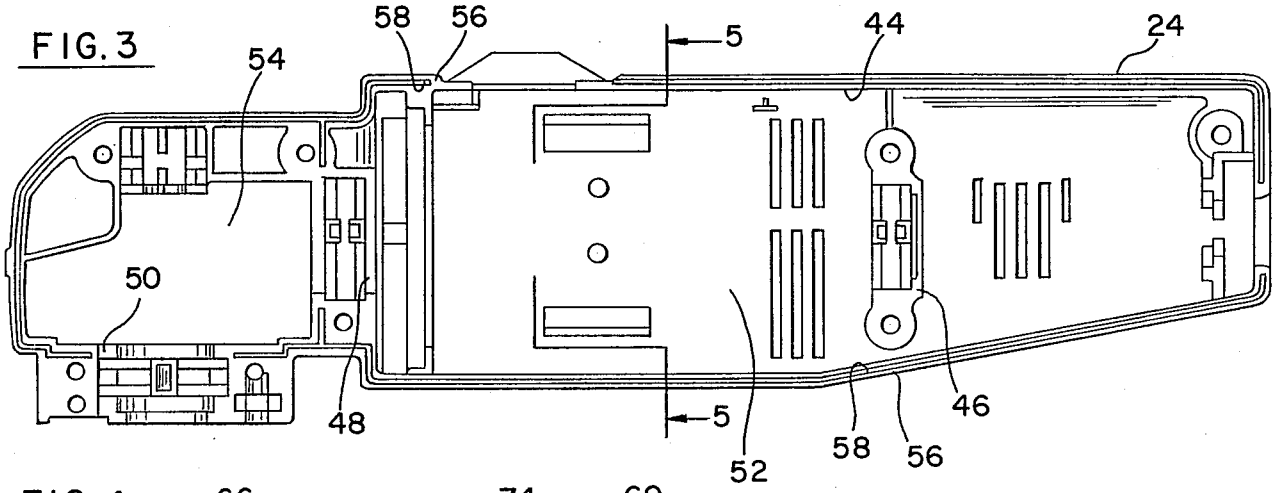
FIG. 3 is a side elevation view showing a first clamshell section which forms one half of a housing for the power tool of FIG. 1.
Figure 5:
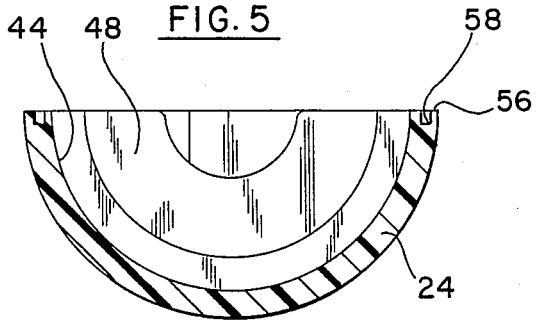
FIG. 5 is a sectional view taken along line 5—5 of FIG. 3 showing details of the first clamshell section with a groove formed in the peripheral edge thereof.

Referring now to FIG. 3, there is illustrated an interior view of clamshell section 24 which is formed in a shell-like configuration having a hollow inner side 44 (FIG. 5). Clamshell section 24 is formed with a bearing support 46 and walls 48 and 50 which, along with inner side 44, define compartments 52 and 54. Compartments 52 and 54 form one half of the motor and gear cases 34 and 36 (FIG. 2), respectively. Clamshell section 24 is formed with a peripheral edge 56 substantially around the perimeter thereof with a first mating means such as a groove 58 formed in the edge as further illustrated in an enlarged fashion in FIG. 5. In addition, bearing support 46 and walls 48 and 50 are formed with peripheral edges which lie in a common plane with the peripheral edge 56 of the clamshell section 24.

Figure 4:
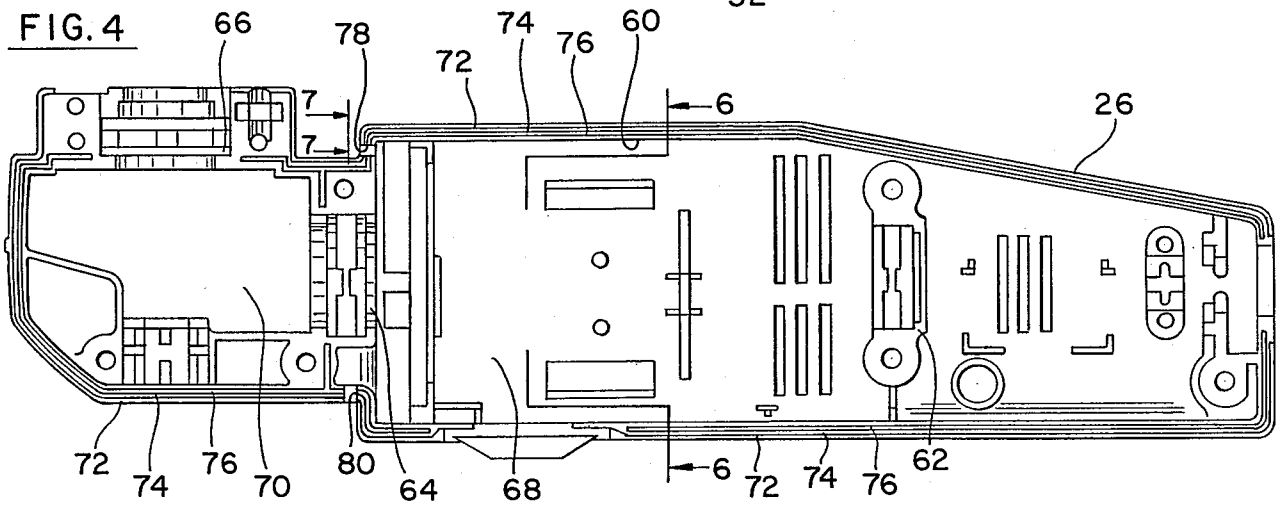
FIG. 4 is a side elevation view showing a second clamshell section which forms the other half of the housing for the power tool of FIG. 1.
Figure 6:
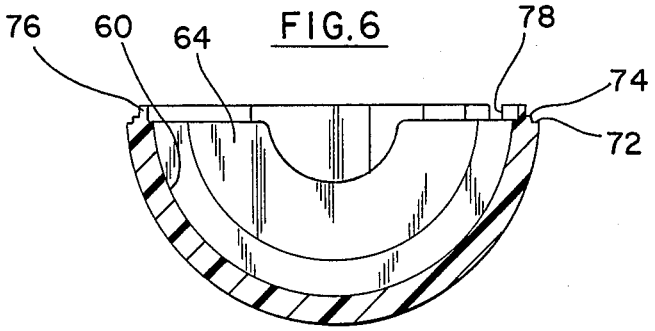
FIG. 6 is a sectional view taken along 6—6 of FIG. 4 showing a rib located on the peripheral edge of the second clamshell section.
Figure 7:
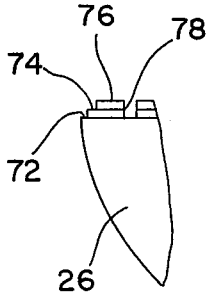
FIG. 7 is a view taken along line 7—7 of FIG. 4 showing one gap formed in the rib of the second clamshell section.

Referring to FIG. 4, there is illustrated an interior view of clamshell section 26 which is also formed in a shell-like configuration having an inner side 60 (FIG. 6). Clamshell section 26 is formed with a bearing support 62 and walls 64 and 66 which, along with inner side 60, define compartments 68 and 70. Compartments 68 and 70 form the other half of the motor and gear cases 34 and 36 (FIG. 2), respectively. Clamshell section 26 is formed with a peripheral edge 72 substantially around the perimeter thereof. A step 74 is formed integrally on the edge 72 and provides a base for an integrally formed second mating means such as a rib 76 which also extends substantially around the perimeter of the clamshell section 26. An enlarged illustration of the relationship of the edge 72, step 74 and rib 76 is shown in FIG. 8.

In one example of assembling the elements of grinder 20, the motor is placed into compartment 68 of clamshell section 26 with opposite ends of the motor resting in journals formed in bearing support 62 and wall 64. The gearing is placed in compartment 70 and is journalled in walls 64 and 66. The gearing is mechanically coupled to the motor and to the driving spindle 40 (FIG. 1). The power cord 38 is assembled within clamshell section 26 and is then connected through switch 42 to the motor. Any one or more lubricating substances, such as oil, grease and the like, are deposited onto appropriate locations of the gearing and related bearings (not shown) ultimately to provide lubrication for the working parts thereof in a conventional manner.

Figure 8:
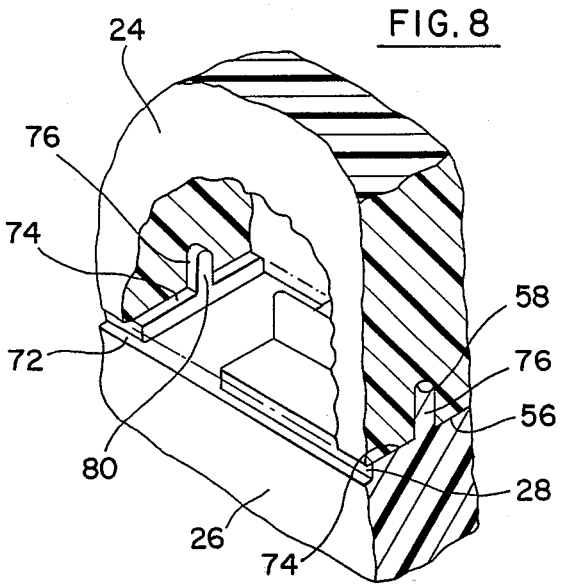
FIG. 8 is an enlarged perspective view of a portion of FIG. 2 showing assembled portions of the first and second clamshell sections of FIGS. 3 and 4 and further showing the rib of the second clamshell section nested in the groove of the first clamshell section with parts broken away from the first clamshell section to show another gap formed in the rib.

Thereafter clamshell section 24 is placed over clamshell section 26 so that the groove 58 of clamshell section 24 is positioned over rib 76 of clamshell section 26 as illustrated in the enlarged view of FIG. 8 whereby the rib is nested in the groove. In this manner, the complementary clamshell sections 24 and 26 are joined to form the housing 22 whereby compartments 52 and 54 of clamshell section 24 mate with compartments 68 and 70, respectively, of clamshell section 26 to form motor and gear cases 34 and 36, respectively. Groove 58 and nested rib 76 cooperates as a pair of mating means to form an interlock which functions as a means for interlocking the clamshell sections 24 and 26 in the assembled relationship to preclude lateral movement of the clamshell sections relative to each other. Screws 32 are then assembled in appropriate locations to function as a means for retaining the clamshell sections 24 and 26 in the assembled interfacing relationship. The assembled grinder 20 is now ready for use.

During use of the grinder 20, the user typically holds the housing 22 in the vicinity of the exterior of the motor case 34. The motor drives the gearing whereby the moving parts become heated and the lubricating substance is also heated and worked by the moving parts. Under these conditions, the viscosity of the lubricating substance is altered and the substance becomes a more flowable substance. Ultimately, due to the rotational driving of the moving parts within the gear case, some of the lubricating substance is unavoidably and undesirably deposited by centrifugal force onto the inner surfaces of gear case 36. The lubricating substance then works its way into the housing interlock formed by the portions of groove 58 and nested rib 76 which are contiguous with the gear case. The interlock then becomes a natural track for the flowable lubricating substance where, by capillary action of wicking, the substance creeps along the interlock toward the motor case 34.

As the flowable substance creeps along the interlock, the substance picks up dirt and dust particles which are normally in the surrounding atmosphere. Eventually, the substance reaches the portion of the interlock which is contiguous with the motor case 34 and tends to deposit on the exterior of the motor case. This results in a slippery and dirty surface for handling by the operator and creates a potentially unsafe condition. Also, due to inward air leakage drawn through the housing interlock by the flow of cooling air about the motor, the creeping substance is drawn from the interlock and flows into the motor case 34. The substance which enters the motor case 34 picks up carbon brush dust and other debris within the motor case and eventually deposits on the motor and related moving parts. This dust and debris laden substance contaminates the motor and related parts and contributes adversely to operation of the motor and could cause unsafe operating conditions and eventual breakdown.

Traditionally, interference fits, rubber seals, sealing compounds and the like have been employed in an attempt to reduce the deleterious effects of lubrication leakage. The incorporation of interference fits or rubber seals usually requires substantial modification of existing parts to accommodate the additional features. Further, the use of sealing compounds tends to create a messy environment in the areas of compound application which is particularly bothersome when there is a need to disassemble the power device. In particular, the traditional solutions of interference fits or rubber seals would not be adaptable for the housing interlock structure of grinder 20 without substantial modifications to the housing structure. Further, the application of a sealing compound in the area of the existing interlock would create an undesirable messy appearance along the exterior of the interlock and potentially add to the handling problem noted above. In any event, this would be unacceptable.

In the preferred embodiment of the invention, as illustrated in FIGS. 2, 4, 6, 7 and 8, the housing interlock of grinder 20 is modified to provide an anti-wicking facility which eliminates the creepage of the flowable lubricating substance without the need to employ the traditional solutions noted above. In particular, a pair of transverse slots 78 (FIGS. 4, 6 and 7) and 80 (FIGS. 2, 4 and 8) are formed at strategic locations through the step 74 and rib 76 to form transverse gaps which interrupt the continuity of the step and rib and thereby interrupt the continuity of the housing interlock along two spaced paths between the motor case 34 and the gear case 36. As illustrated in FIG. 4, slots 78 and 80 are formed in step 74 and rib 76 at opposite ends of wall 64 and are located just beyond gear case 36 (FIG. 1) toward motor case 34 (FIG. 1). It is noted that the perspective view of FIG. 8 is an enlarged representation of the area illustrated in FIG. 2 which includes slot 80 but with parts of clamshell section 24 broken away to show slot 80 and to show the interlock relationship between the rib 76 and the groove 58. It is further noted that slot 78 (FIG. 4) is of the same shape and configuration as slot 80.

As the flowable substance creeps or wicks along the two spaced paths of the housing interlock in the vicinity of gear case 36, the leading portions of the substance eventually reach the gaps formed by the slots 78 and 80 on opposite sides of the housing 22. Since the flow of the substance is by capillary action, i.e. a wicking action, the substance cannot breach the gaps whereby the substance is prevented from creeping any further along the interlock.

Thus, the formation of at least one gap provides a means for precluding the movement of a flowable substance from a compartment, such as gear case 36 of the housing 22, along an interlocking means, such as the interlock formed by the groove 58 and nested rib 76, to other areas of the housing.

The provision of one or more gaps in the housing interlock does not interfere with the normal operation of the power device. Further, the gap eliminates the potential for appearance of the flowable substance on the exterior of the housing 22 in the area where the operator would normally hold the power device during normal use and also eliminates the potential for appearance of the substance within the motor case 34.

It is noted that, in the preferred embodiment, two slots 78 and 80 are located as illustrated in FIG. 4. However, slots could be formed at locations other than those illustrated in FIG. 4 or slots in addition to those illustrated could be formed all without departing from the spirit and scope of the invention. Also, in some instances, a single slot, such as slot 78, could provide the necessary gap to preclude the capillary creepage of the flowable substance along an interlock to a spaced location. Further, the invention has utility with any power device housing where the flowable substance creeps along a trackless housing joint formed by an interfacing means such as engaged surfaces of two mating housing sections. In particular, the invention has utility with any power device housing which utilizes the interlocking means such as that formed by the groove 58 and nested rib 76. In addition, the gap formed by either of the slots 78 or 80 can be many times the magnitude of the housing interlock, along which the capillary creepage would occur, and still be unobstrusive.

Thus, the anti-wicking facility embodied in the invention, and as described heretofore, provides a relatively inexpensive and highly effective technique for eliminating the undesirable creepage of a lubricant from gear case 36 along the interlock of housing 22 to the exterior as well as the interior of motor case 34.

Obviously, many modifications may be made without departing from the basic spirit of the present invention. Accordingly, it will be appreciated by those skilled in the art that within the scope of the appended claims, the invention may be practiced other than as has been specifically described herein.

I claim:

1. A housing of a power device, which comprises:

a first housing means for forming a portion of the housing of the device;

a second housing means for forming another portion of the housing of the device;

the first housing means formed with a recess in a surface which engagingly interferes with a corresponding surface of the second housing means upon assembly of the first and second housing means;

the second housing means formed integrally with rigid means on the corresponding surface for complementary assembly with the recess of the first housing means when the first and second housing means are placed in an assembled relationship to form the housing;

means formed internally of the first and second housing means for forming an enclosure internally of the housing when the first and second housing means are in the assembled relationship; and the rigid means includes anti-wicking means for preventing the wicking of a flowable substance from a first portion of the enclosure along the rigid means to a second portion of the enclosure spaced from the first portion thereof, the anti-wicking means integrally formed on the rigid means and being independently separated from the first housing means.

2. The housing as set forth in claim 1 wherein the preventing means precludes the wicking of the flowable substance into the second portion of the enclosure.

3. The housing as set forth in claim 1 wherein the preventing means precludes the movement of the flowable substance onto the exterior of the second portion of the enclosure.

4. The housing as set forth in claim 1 wherein the first housing means and the second housing means are formed with surfaces which are placed in interfacing engagement when the first and second housing means are assembled to form the housing; and the rigid means and the recess form a means for interlocking the first and second housing means in an assembled relationship to form the housing.

5. The housing as set forth in claim 4 wherein the means for interlocking includes:

the recess being formed in the interfacing surface of the first housing means for forming a first portion of the interlocking means; and the rigid means formed in and projecting from the interfacing surface of the second housing means for forming a second portion of the interlocking means;

the recess and the rigid means being nested to form an interlock between the first housing means and the second housing means when the first and second housing means are in the assembled relationship and thereby prevent movement of the first housing means relative to the second housing means along the surfaces of interfacing engagement thereof.

6. The housing as set forth in claim 4 wherein the surfaces of the first and second housing means which are in interfacing engagement extend along two spaced paths contiguous with the enclosure, and wherein the prevention means is located in each of the two spaced paths to interrupt the continuity of each of the two spaced paths and thereby preclude wicking movements of the flowable substance from the first portion of the enclosure to the second portion thereof along the two spaced paths.

7. The housing as set forth in claim 6 which further comprises:

means for retaining the first and second housing means in the assembled relationship.

* * * * *